United States Patent [19]

Alvarez

[11] 4,103,418

[45] Aug. 1, 1978

[54] MANUALLY-OPERATED REVOLVABLE SHAVING DEVICE

[76] Inventor: Marcial Alvarez, 225 E. Jersey St., Elizabeth, N.J. 07206

[21] Appl. No.: 819,108

[22] Filed: Jul. 26, 1977

Related U.S. Application Data

[63] Continuation-in-part of Ser. No. 732,744, Nov. 9, 1976, abandoned.

[51] Int. Cl.[2] ..... B26B 21/00

[52] U.S. Cl. ..... 30/50; 30/49; 30/40

[58] Field of Search ..... 30/32, 48, 49, 50, 51, 30/52, 85, 346.57, 346.58, 87, 57, 90, 40

[56] References Cited

U.S. PATENT DOCUMENTS

| | | | |
|---|---|---|---|
| 737,775 | 9/1903 | Robedeau | 30/85 X |
| 2,342,291 | 2/1944 | Morelli | 30/50 |
| 3,299,507 | 1/1967 | Mistretta | 30/86 |

*Primary Examiner*—Jimmy C. Peters
*Attorney, Agent, or Firm*—Stefan J. Klauber

[57] ABSTRACT

A manually-operated shaving device, for shaving skin areas during or incidental to surgical or cosmetic treatment. The device comprises a generally wheel-shaped shaving body, the rim of which carries a plurality of shaving edges. A handle means is rigidly secured to the wheel and extends outwardly in alignment with the wheel axis, to thereby enable oscillating clockwise and counterclockwise rotation of the wheel by operator manipulation of the handle means. A support member is secured to the side of the wheel opposite the handle means, and extends a short distance from the wheel in alignment with the said wheel axis. The member includes a smooth concavity at its distal end for receiving the finger tip of the hand of the operator which is opposed to that manipulating the handle means. The contacting finger serves as a pivotal support during rotation and orientation of the shaving body with respect to the skin area being treated. The plurality of shaving edges are spaced with respect to one another about the wheel circumference, and alternating of the edges are oriented with respect to the rim surface as to effect shaving of the skin during respectively clockwise and counterclockwise rotation of the wheel by the operator.

13 Claims, 3 Drawing Figures

MANUALLY-OPERATED REVOLVABLE SHAVING DEVICE

This application is a continuation-in-part of my copending application Ser. No. 732,744, filed Nov. 9, 1976, and entitled "SPINNING SHAVER" which application is now abandoned.

BACKGROUND OF INVENTION

This invention relates generally to devices for shaving portions of the human body, and more specifically relates to manually-operated devices of this type, which are especially adapted for shaving of anatomical features presenting generally non-planer or irregular surfaces.

During the course of surgical treatment of portions of the human body, as for example, as an incident of treatment of trauma or disease, a physician is frequently required to shave the anatomical area to be treated—in order to eliminate surface hair which could interfere with the surgical procedure, or with healing of the impaired bodily portion. In many instances in which such shaving operation is thus required, the anatomical feature to be treated may be irregular in nature, or in any event generally non-planer, in consequence of which conventional shaving implements are poorly adapted to operate upon the skin surface. Especially where such irregularities or departure from flatness is present, a fine degree of operator control is required in use of the shaving implement—in order to assure that effective and safe shaving is effected.

Pursuant to the foregoing it may be regarded as an object of the present invention, to provide a shaving implement which is entirely manually operated, and which is especially adapted for accurately controlled shaving of anatomical areas having irregular or non-planer surfaces.

It is a further object of the present invention, to provide a manually operated shaving implement, especially useful in the shaving of areas of the skin which are to be subjected to surgical treatment or the like, which device is susceptible of accurate control by the user thereof, and which is adapted for carefully controlled contact with skin areas located in anatomical regions of relatively difficult accessibility.

SUMMARY OF INVENTION

Now in accordance with the present invention, the foregoing objects, and others as will become apparent in the course of the ensuing specification, are achieved in a manually-operated shaving device, which while especially adapted for use in shaving skin areas during or as an incident of surgical treatment or the like, is also useful in other applications wherein shaving of a skin area is desirable as, for example, for cosmetic reasons, or for reasons of convenience or the like.

The implement of the invention comprises a generally wheel-shaped shaving body, the outwardly facing peripheral surface or rim of which carries a plurality of at least partially protruding shaving blades, which may be mounted in a series of recesses formed into the rim surface. A handle means is rigidly secured to the wheel and extends outwardly therefrom in alignment with the wheel axis, as to enable oscillating clockwise and counterclockwise rotation of the wheel by operator manipulation of the handle means. A support member, similarly aligned with the wheel axis, extends from the side of the wheel opposite the handle means. This support member includes at its distal end a smooth concavity adapted for receiving the finger tip from that hand of the operator which is opposed to the hand manipulating the handle means. The contacting finger thereby serves as a pivotal support during rotation and orientation of the shaving body with respect to the skin area being treated. The plurality of rim-carried blades are spaced with respect to one another about the wheel rim, and alternating of the blades are oriented with respect to the rim surface to effect shaving of the skin during respectively clockwise and counterclockwise rotation of the wheel by the operator.

The handle means may comprise a relatively extended cylinder, which is adjoined to the wheel by a generally cone-shaped portion which tapers inwardly toward the wheel; and the support member may comprise a generally cone-shaped body, which similarly tapers inwardly in the direction of the wheel. The two cone-shaped elements mentioned, serve to facilitate tipping of the wheel axis with respect to the underlying skin surface, thus facilitating manipulation of the shaving wheel into depressions or crevices in the skin surface.

BRIEF DESCRIPTION OF DRAWINGS

The invention is diagrammatically illustrated, by way of example, in the drawings appended hereto, in which.

DESCRIPTION OF PREFERRED EMBODIMENT

Figure 1:
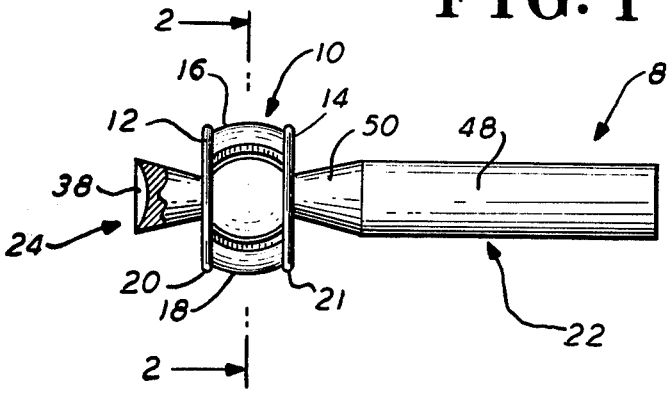
FIG. 1 is a side elevational view of a shaving device in accordance with the present invention.

In FIG. 1 herein a side elevational view appears of a shaving implement or device 8 in accordance with the present invention. Device 8 is seen to consist generally of a shaving body in the form of a wheel 10, which wheel is defined by end portions 12 and 14, and a peripheral surface 16 which extends in somewhat arcuate fashion between end portions 12 and 14. The edges of portions 12 and 14 are somewhat raised with respect to surface 16, to define shoulders 20 and 21. Surface 16 together with shoulders 20 and 21 are thus seen to define the rim 18 of the wheel 10.

All of the portions of wheel 10 thus far mentioned can be formed as a single unit, e.g. of machined stainless steel or the like—although it is also within the province of the invention for the wheel 10 to comprise several separable portions joined together: For example, portions 12 and 14 can be separately manufactured and joined to a separate piece which includes the surface 16.

A handle means generally indicated at 22 is rigidly joined to the wheel 10 at the center of portion 14, and extends outwardly from wheel 10 in alignment with the axis thereof. On the opposite side of wheel 10 a support member 24, which is much foreshortened in relation to handle means 22, is similarly rigidly joined to the center of portion 12, and thence extends outwardly from wheel 10 in alignment with the wheel axis.

Both handle means 22 and support member 24 can again be integrally formed with the wheel 10, e.g. by the entire device 8 shown in FIG. 1 being machined from a single piece of stainless steel or the like. Especially where materials such as the aforementioned stainless steel or other highly chemically resistant materials are used (e.g. aluminum), advantages attach to such one-piece construction. Since in particular the present device is commonly used in surgical applications, such a unit construction is advantageous in limiting corrosion, and in facilitating cleaning and sterilization. However, it is equally within the province of the invention for handle means 22, support member 24 and wheel 10 to comprise separate elements, which are rigidly secured with respect to one another by conventional joining operations.

Figure 2:
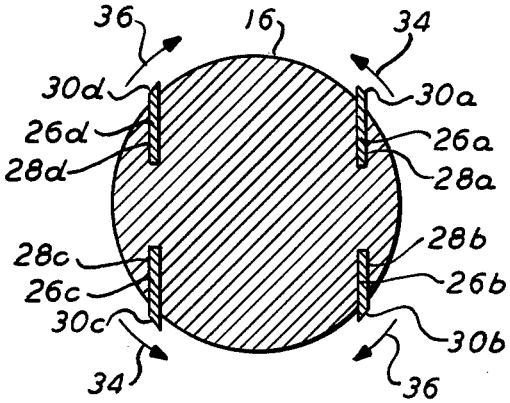
FIG. 2 is a transverse cross-section through the shaving wheel portion of the FIG. 1 device, such view being taken along the line 2—2 of FIG. 1.
Figure 3:
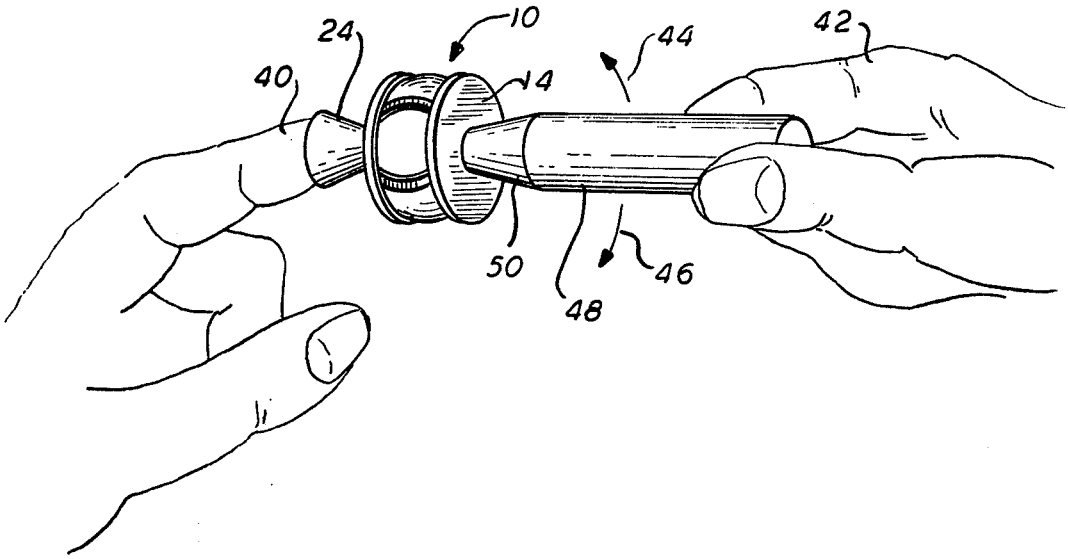
FIG. 3 is a perspective view, illustrating the manner in which the present device is supported and manipulated in the course of effecting a shaving operation.

Wheel 10 as may be seen by simultaneous reference to the cross-sectional view of FIG. 2 and to the perspective view of FIG. 3, carries a plurality of shaving blades 26*a*, 26*b*, etc., which blades are received within slots or recesses 28*a*, 28*b*, etc., formed into rim surface 16. In a typical arrangement, and as shown in the Figures herein, four such slots 28*a* through 28*d*, and four blades 26*a* through 26*d* are thus mounted. The recesses or slots 28*a* etc. may again be formed by a simple machining operation, or if the wheel 10 is formed by casting, molding or the like, the recesses may be formed during the casting or molding operation. In either event, the said blades are mounted within the slots after manufacture of the wheel, and may be retained in such slots by conventional adhesives as, for example, suitable epoxy systems or the like; or depending upon the nature of the specific materials the said blades can be retained by metal fusing operations or so forth.

By reference especially to the cross-sectional view of FIG. 2 it will be seen that the actual cutting edges 30*a*, 30*b*, etc. of the said blades are equidistantly spaced about the circumference of the wheel rim 18, i.e. the said cutting edges 30*a*, etc. are successively spaced at 90° intervals about said circumference. Of further significance is the fact that successive of such cutting edges as, for example, the edges 30*a* and 30*b*, are oriented with respect to the rim circumference to enable shaving in the one instance when the wheel is rotated in a counterclockwise direction 34, and on the other hand when the wheel is rotated in a clockwise direction 36. This is in consequence of the fact that the slots as, for example, slots 28*a* and 28*b*, are located at the extremeties of a chord to the circular cross-section; hence in the instances mentioned the blade 26*a* mounted in a slot 28*a* makes an acute angle with the rim surface 16 to enable shaving when the wheel is rotated in the counterclockwise direction 34; whereas the slot 28*b* is oriented such that the edge 30*b* of blade 26*b* makes an acute angle with the rim surface 16 such that shaving can be effected by that blade edge only when the wheel is rotated in the clockwise direction 36.

By reference to FIG. 3 herein (in conjunction with the prior Figures), the general mode of operation of device 8 will now become evident. In that connection it will firstly be noted that the support member 24 is a foreshortened piece having an axial length approximating the axial thickness of wheel 10. The said member 24 further is seen to be of generally cone-like shape (actually a truncated cone), and further is provided with a recess or concavity 38 at its distal end. The said concavity 38, by virtue of the materials and form thereof, is very smooth in nature; and as seen in FIG. 3 the tip of index finger 40 of the operator of device 8, may be received into recess 38, where such finger serves to support the device 8 to enable rotation of the wheel about its axis 10 by the operator manipulating handle means 22 with his other hand 42; and similarly the device 8 as thus supported, may be tilted upwardly or downwardly, i.e. in the general directions of arrows 44 and 46, again with the tip of finger 40 serving as a pivot by virtue of its contact with recess 38.

In addition to the aforementioned fact that support member 24 is cone-like in shape, it will be seen that handle means 22 is actually defined by an extended cylindrical portion 48 which is adjoined to the wheel 10 via a portion 50—which again is cone-like in form (actually a truncated cone), which tapers inwardly from its base adjoining cylindridal portion 48 to the point where it joins wheel 10. The axial extent of portion 50 is approximately equal to the axial length of member 24, i.e. again being approximately the axial thickness of wheel 10. Pursuant to prior discussion, it will of course be appreciated that portions 48 and 50 can comprise a single machined piece of metal or so forth.

In consequence of the presence of the cone-like elements on either side of wheel 10, the operator in using device 8 is able to manipulate or tip the device in the directions of arrows 44 and 46 to a greater extent than would otherwise be possible, while yet maintaining the wheel and its blade-bearing rim 18 in contact with a skin area to be shaved. This even where the portion of the anatomy involved, possesses considerable irregularity, ridges, depressions, or the like.

The cylindrical portion 48 of handle means 22 is typically at least as long as the distance between the bases of the cone-shaped portion 48 and the cone-like member 24. By providing a length for portion 48 which is at least of the aforementioned dimension, good operator control of the device 8 is enabled. It will, of course, be evident that during use the operator, as shown in FIG. 3, rotates handle means 22 successively to and fro, i.e. the operator successively oscillates the said device in clockwise and counterclockwise directions while maintaining the bladed wheel 10 in contact with the area to be shaved. In consequence the various adjacent blade edges 30*a* etc. pass successively in one or the other direction in contact with the area to be shaved, with successive blades impinging upon hairs to be removed from opposed directions—in consequence of which shaving is facilitated. At the same time accurate control of the angularity or tipping of the said device (i.e. tipping of the wheel axis with respect to the surface to be shaved) is enabled by virtue of the cone portions previously mentioned, and by virtue of the carefully controlled pivotal support possible with the present construction.

While the present invention has been particularly described in connection with specific embodiments thereof, it will be understood in view of the present disclosure that numerous variations upon the invention are now enabled to those skilled in the art, which variations yet reside within the scope of the present teaching. Thus, for example, the invention is not limited to the use of any particular materials. In some instances, e.g. materials other than metals may be used—particularly where the device is not intended for surgical applications, and hence does not require the ability to withstand high temperature cleaning and sterilization. Similarly it will be evident that various other arrangements in numbers or dispositions of the shaving blades is possible, within the teachings otherwise set forth in the present disclosure.

Accordingly the present invention is to be broadly construed, and limited only by the scope and spirit of the claims now appended hereto.

I claim:

1. A manually-operated device for shaving areas of the skin in the course of surgical or cosmetic treatment or the like, said device comprising:

a wheel-shaped shaving head, the rim of said wheel carrying a plurality of at least partially protruding shaving blades;

generally cylindrical handle means rigidly secured to said wheel, and extending outwardly therefrom in alignment with the wheel axis, said means being of reduced diameter with respect to the diameter of said shaving head and being adapted for grasping by an operator to enable manual rotation of said wheel about said axis by rotation of said handle means; and a support member secured to said wheel and extending in alignment with the wheel axis from the side of said wheel opposite said handle means, said member being foreshortened in comparison to said handle means and adapted to be pivotably and rotatably supported by the hand of said operator opposed to that manipulating said handle means, thereby enabling rotation and orientation of said shaving body with respect to the skin area being shaved.

2. A device in accordance with claim 1, wherein said blades are spaced with respect to one another about the surface of said rim, at least a first of said blades being inclined toward said rim surface in a first direction with respect to the wheel circumference, and at least a second of said blades being inclined toward said rim surface in the opposite direction with respect to said circumference, whereby said first and second blades are oriented to respectively shave said skin during clockwise and counterclockwise rotation of said wheel by said operator.

3. A device in accordance with claim 2, wherein said blades with said differing inclinations alternate among said plurality of blades spaced about said rim.

4. A device in accordance with claim 3, wherein said blades are four in number, and are equidistantly spaced about the said rim.

5. A device in accordance with claim 1, wherein said support member is rigidly secured to said wheel and includes a smooth concavity at the distal end thereof for receiving a finger tip of said operator, to enable said pivotal and rotatable support.

6. A device in accordance with claim 5, wherein said handle means and said support members are tapered inwardly at least at the portions thereof where said members are affixed to said wheel, thereby to facilitate inclination of said wheel axis during orientation of said shaving head during manipulation thereof.

7. A manually-operated shaving implement for shaving skin areas during surgical or cosmetic treatment or the like, said implement comprising in combination:

a generally wheel-shaped shaving body, the outwardly facing rim surface of said wheel carrying a plurality of shaving edges;

a generally cylindrical handle means of diameter substantially less than that of said wheel being rigidly secured to said wheel and extending axially therefrom, to enable rotation of said wheel by operator rotation of said handle means; and a support member extending axially from the side of said wheel opposite said handle means, said member being foreshortened in comparison to said handle means and including a smooth concavity at the distal end thereof for receipt of the finger tip from the hand of said operator opposite that manipulating said handle means, said contacting finger thereby serving as a pivotal support during rotation and orientation of said shaving body with respect to the skin area being shaved.

8. A device in accordance with claim 7, wherein said plurality of shaving edges are spaced with respect to one another about said rim surface, alternating of said blades being oriented with respect to said surface to effect shaving of said skin during respectively clockwise and counterclockwise rotation of said wheel by said operator.

9. A device in accordance with claim 8, wherein shaving edges are provided at blades mounted in recesses formed into said rim surface.

10. A device in accordance with claim 8, wherein said handle means comprises a relatively extended cylindrical portion adjoined to said wheel by a generally cone-shaped portion tapering inwardly toward said wheel; and wherein said support member comprises a generally cone-shaped body tapering inwardly in the direction of said wheel; said cone-shaped portion and body serving to facilitate manipulation of said wheel into contact with anatomical areas during use of said shaving implement.

11. A device in accordance with claim 10, wherein the length of said support member is approximately the axial thickness of said wheel.

12. A device in accordance with claim 11, wherein the cone-shaped portion of said handle means has a length approximately equal to the axial thickness of said wheel.

13. A device in accordance with claim 12, wherein the length of the cylindrical portion of said handle means is at least as great as the distance between the base of said cone-shaped portion of said handle and the base of said cone-shaped support member.

* * * * *